United States Patent [19]

Webster et al.

[11] Patent Number: 4,601,659

[45] Date of Patent: Jul. 22, 1986

[54] SKID RAIL

[75] Inventors: Charles G. Webster, West Lothian, United Kingdom; John S. Smith; Frank Campbell, Jr., both of Houston, Tex.

[73] Assignee: Cameron Iron Works, Inc., Houston, Tex.

[21] Appl. No.: 620,632

[22] Filed: Jun. 14, 1984

[30] Foreign Application Priority Data

Nov. 9, 1983 [EP] European Pat. Off. ..... 83306830

[51] Int. Cl.[4] ..... F27D 3/02

[52] U.S. Cl. ..... 432/234

[58] Field of Search ..... 432/234

[56] References Cited

U.S. PATENT DOCUMENTS

| | | | |
|---|---|---|---|
| 3,304,070 | 2/1967 | Jones | 432/234 |
| 3,588,059 | 6/1971 | Weineck et al. | 432/234 |
| 3,642,261 | 2/1972 | Laws | 432/234 |
| 4,080,152 | 3/1978 | Altfeld et al. | 432/234 |
| 4,293,299 | 10/1981 | Gaddes | 432/234 |
| 4,354,824 | 10/1982 | Campbell, Jr. | 432/3 |
| 4,470,808 | 9/1984 | Knaak et al. | 432/234 |

FOREIGN PATENT DOCUMENTS

| | | | |
|---|---|---|---|
| 2134622 | 3/1973 | Fed. Rep. of Germany | 432/234 |
| 2143214 | 3/1973 | Fed. Rep. of Germany | 432/234 |

*Primary Examiner*—John J. Camby

*Attorney, Agent, or Firm*—Vinson & Elkins

[57] ABSTRACT

A skid rail for a reheat furnace which supports the slabs or work pieces moving therethrough without excessive cooling or tiger striping of such work pieces including a hollow structural member having an upper surface, a wear bar having a plurality of support blocks secured thereto for supporting the wear bar in a position above the upper surface of the structural member, cleats engaging the blocks to secure the wear bar on the surface and insulation under the wear bar and around the blocks and cleats, the material of the wear bar and the blocks having low thermal conductivity and high strength when subjected to the elevated temperatures of the reheat furnace.

13 Claims, 9 Drawing Figures

SKID RAIL

BACKGROUND

Reheat furnaces are used to heat heavy slabs of metal (work pieces) which are moved through the furnace supported on water cooled structural members called skid rails. These skid rails include a wear bar secured to the top of the skid rails for contact with the slabs. The contact between the wear bars and the slabs allows heat transfer from the slabs to the skid rails which produce lines of chilling sometimes called "tiger stripes". Elimination of such tiger stripes is desired particularly where the slabs are to be used in producing steel strips so that a uniform gauge strip may be produced.

An example of the work of the prior art to eliminate these tiger stripes is shown in U.S. Pat. No. 4,354,824 wherein the wear bars secured to the top of the structured member are staggered, spaced apart and the top surface of the structural member covered between the wear bars with a metal honeycomb reinforced insulation. While such structure has been very successful in minimizing the heat transfer from the slab to the skid rail, the wear bars still allow some cooling of the slab.

Another example of the prior art is disclosed in U.S. Pat. No. 3,214,152 which discloses a work engaging means supported from a rail on two stacked blocks made of ceramic material with the lower block which engages the structural member having a density substantially less than the upper block. It also suggests that the work engaging means may be made of a material having a very high resistance to heat such as cobalt or molybdenum. The use of low density ceramics as a support may provide heat insulation but is subject to damage when heavy work pieces are moved over the work engaging means.

SUMMARY

The present invention relates to an improved skid rail for a reheat furnace including a wear bar of a material having low thermal conductivity which is held on the top of the hollow structural member by a series of cleats which are of a different material from the wear bar and which has a minimum of heat transfer with the wear bar and insulation under the wear bar substantially covering the top of the structural member.

An object of the present invention is to provide an improved skid rail to reduce the heat transfer from the work piece to the skid rail.

Another object is to provide an improved wear bar structure for a skid rail which has a minimum of heat transfer with respect to the work piece.

BRIEF DESCRIPTION OF THE DRAWINGS

These and other objects and advantages of the present invention are hereinafter set forth and explained with reference to the drawings wherein.

BRIEF DESCRIPTION OF THE PREFERRED EMBODIMENT

Figure 1:
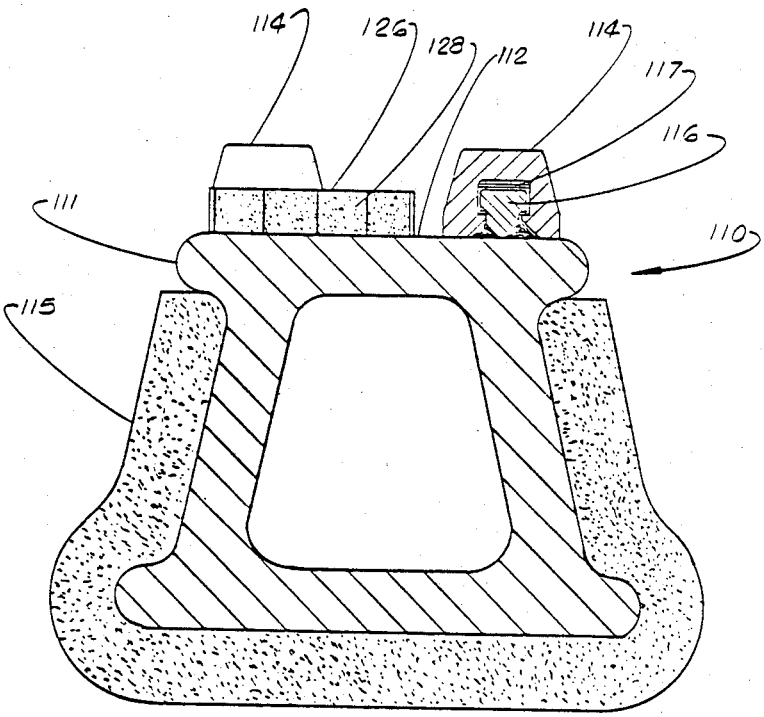
FIG. 1 is a transverse sectional view of the preferred embodiment of the improved furnace skid rail of the present invention taken along line 1—1 of FIG. 2.
Figure 2:
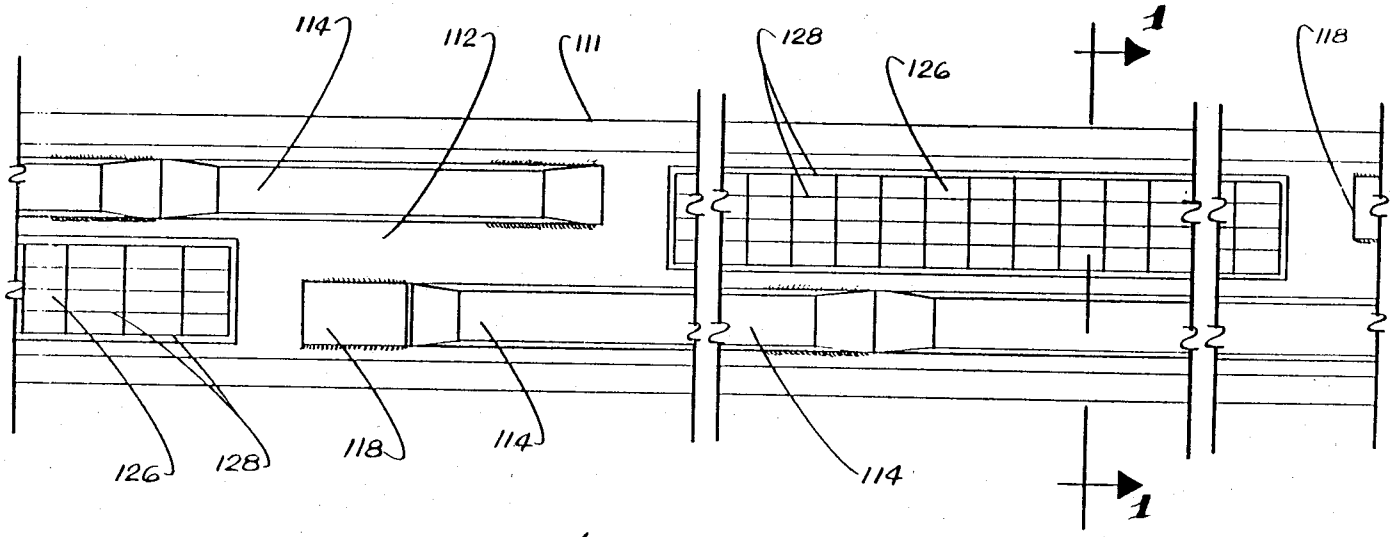
FIG. 2 is a plan view of the improved skid rail shown in FIG. 1.
Figure 3:
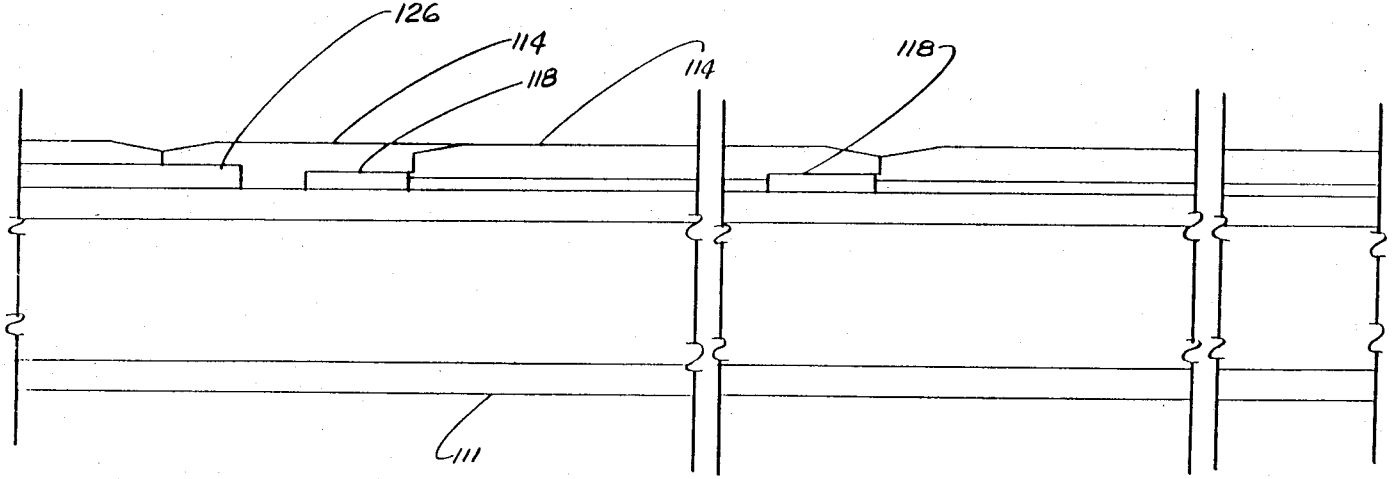
FIG. 3 is an elevation view of the improved skid rail of FIGS. 1 and 2.

The preferred embodiment of the present invention is best shown in FIGS. 1, 2 and 3 wherein skid rail 110 includes truncated triangular pipe 111 having flat upper surface 112 on which wear bars 114 are mounted in intermittent parallel relationship as shown. Insulation 115 is placed on the sides and bottom of pipe 111, as shown in FIG. 1 but omitted for clarity in FIGS. 2 and 3. T-shaped bars or blocks 116 which are welded to surface 112 vertically secure wear bars 114 to pipe 111. Wear bars 114 are longitudinally secured by thrust pads 118, which are welded to top surface 112 of pipe 111. For ease of manufacture and assembly it is preferred that wear bars 114 be comprised of short sections approximately 15 inches long with a thrust pad 118 being at each section-to-section joint and each end. Wear bars 114 have a T-shaped opening so they can be inserted onto T-shaped bars 116 without requiring intimate thermal conducting contact as would result if bars 114 were welded directly to pipe 111. Thermal conductivity is further impeded by inserting insulation 117 between bars 116 and 114 as shown in FIG. 1. It is preferred that insulation 117 be of an alumina silica type, such as that manufactured by Babcock and Wilcox Company of Augusta, Ga. under the trademark Kaowool ST. An additional reduction in high temperature thermal conductivity is obtained by manufacturing wear bars 114 from an iron, chrome, cobalt alloy which has low thermal conductivity at the high temperatures experienced in the metallurgical reheat furnace. A suitable alloy for wear bars 114 would be one having the following composition: C-0.12%; Mn-0.60%; Si-0.07%; Cr-28.00%; Fe-21.00% and Co-49.58%.

Insulating material 126 is embedded in reinforcing frame 128 and is in physical contact with upper surface 112 of pipe 111 and further reduces the heat transfer between the hot slab work piece (not shown) and pipe 111. Insulating material 126 is preferred to be a dual material giving a combination of high thermal resistance, high radiant emissivity and high strength. Such a material is manufactured by A. P. Green Refractory Co. of Mexico, Mo. under the trademark Jade Pak 88P. It is preferred that the wear bars and insulating material be arranged in two separate alternating rows, as best seen in FIG. 2, to further minimize heat transfer from the hot slab and eliminate tiger stripes.

BRIEF DESCRIPTION OF OTHER EMBODIMENTS

Figure 4:
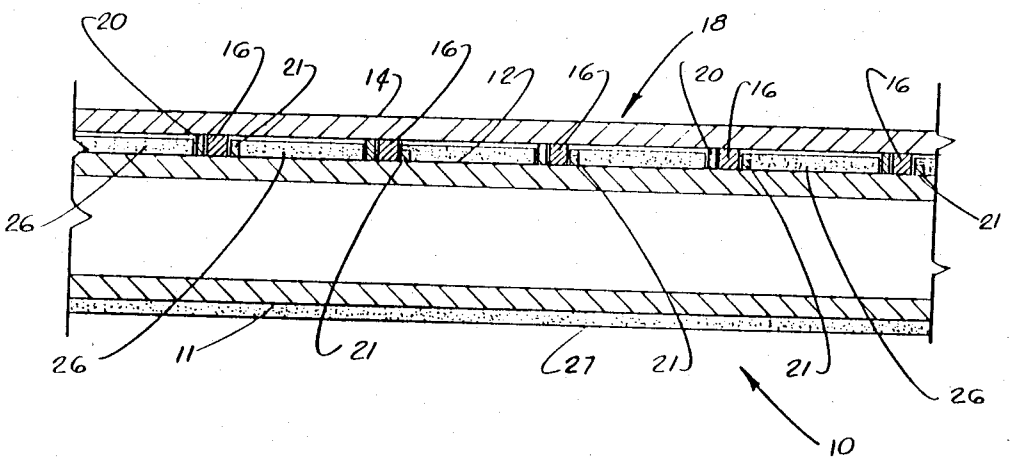
FIG. 4 is a longitudinal sectional view of another embodiment of the improved furnace skid rail of the present invention taken along line 4—4 in FIG. 3.
Figure 5:
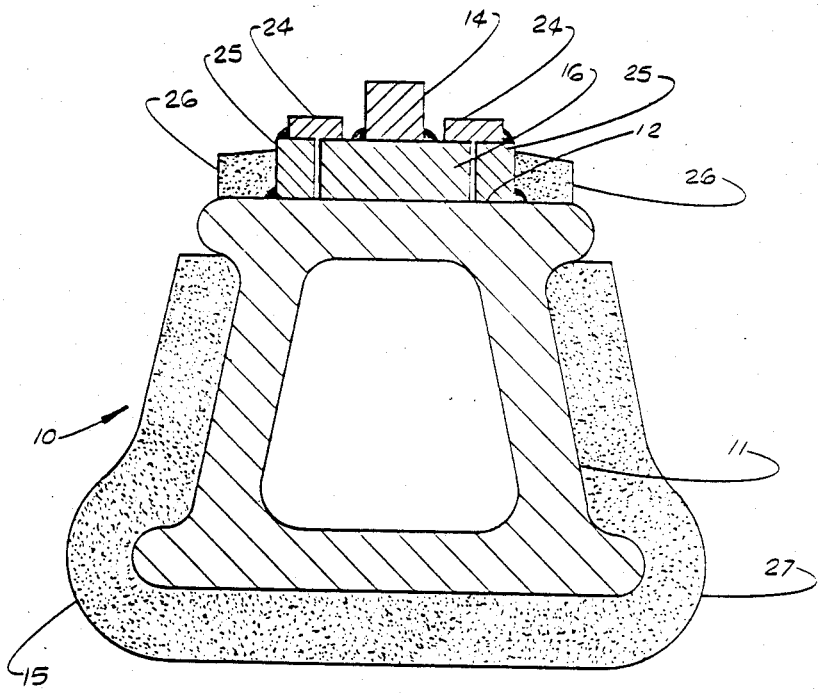
FIG. 5 is a transverse sectional view of the improved skid rail shown in FIG. 4.
Figure 6:
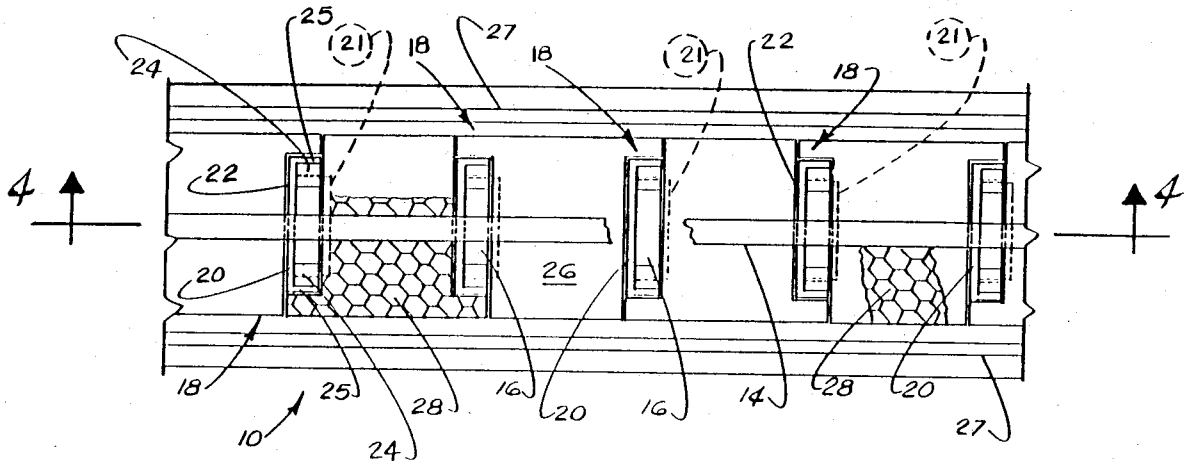
FIG. 6 is a plan view of the improved skid rail shown in FIGS. 4 and 5 illustrating the wear bar retaining means.

A second embodiment of the invention is shown in FIGS. 4, 5 and 6, wherein skid rail 10 includes truncated triangular pipe 11 having flat top surface 12 on which wear bar 14 is mounted and with insulation 15 on the bottom and sides of pipe 11. Blocks 16 support and help secure wear bar 14 by welding. Blocks 16 are uniformly spaced along wear bar 14 with the spacing being provided so that wear bar 14 is not subject to damage due to the slabs or work pieces being moved thereon. Means 18 is provided to retain wear bar 14 and blocks 16 in the desired position relative to surface 12. Such retaining means 18 includes cleats 20 and stops 21 which are secured to surface 12. Cleats 20 and stops 21 are welded on surface 12 in position and sized to secure blocks 16 to skid rail 10 and to allow sufficient space for differences in thermal expansion. Cleat 20 includes U-shaped base 22 and caps 24 on legs 25 of base 22. Caps 24 are secured to legs 25 by welding so that they overhang the outer portions of block 16 as shown. Suitable insulation material 26 is placed within and around reinforcing frame 28 which is secured to surface 12 of pipe 11 by welding. Portions of insulating material 26 have been omitted in FIG. 6 to show reinforcing frame 28. This type of insulation 26 is disclosed in U.S. Pat. No. 4,354,824 and such disclosure is incorporated herein by reference. Pipe 11 is also coated with suitable insulation 27.

As can be seen in FIGS. 4 and 6, insulation 26 extends under wear bar 14 between blocks 16. It is preferred that insulation 26 not be in physical contact with wear bar 14. Also cleats 20 and stops 21 are spaced along surface 12 to engage opposite sides of blocks 16 on wear bar 14 so that blocks 16 fit within the space bounded by legs 25, bases 22 and stops 21. It is preferred that bases 22 with blocks 16 positioned therein are secured to surface 12, then caps 24 are secured to bases 22 to secure blocks 16 in position and thus secure wear bar 14 in place.

With the structure shown and described the material of wear bar 14 and blocks 16 is preferred to be a material having low thermal conductivity and high strength at elevated temperatures such as the nickel based alloy sold by International Nickel Company under the trademark "Incoloy 802".

Insulating material 26 is preferred to be a dual material giving a combination of high thermal resistance, high radiant emissivity and high strength. Cleats 20 and stops 21 are steel and are used since the material of wear bar 14 and block 16 cannot be readily welded to carbon steel, such as pipe 11, due to its chemical incompatibility and different coefficient of thermal expansion. This structure provides a load bearing insulation separating the hot slab from the "heat sink" of the water cooled pipe 11 to thereby eliminate tiger stripes on the hot slab.

Figure 7:
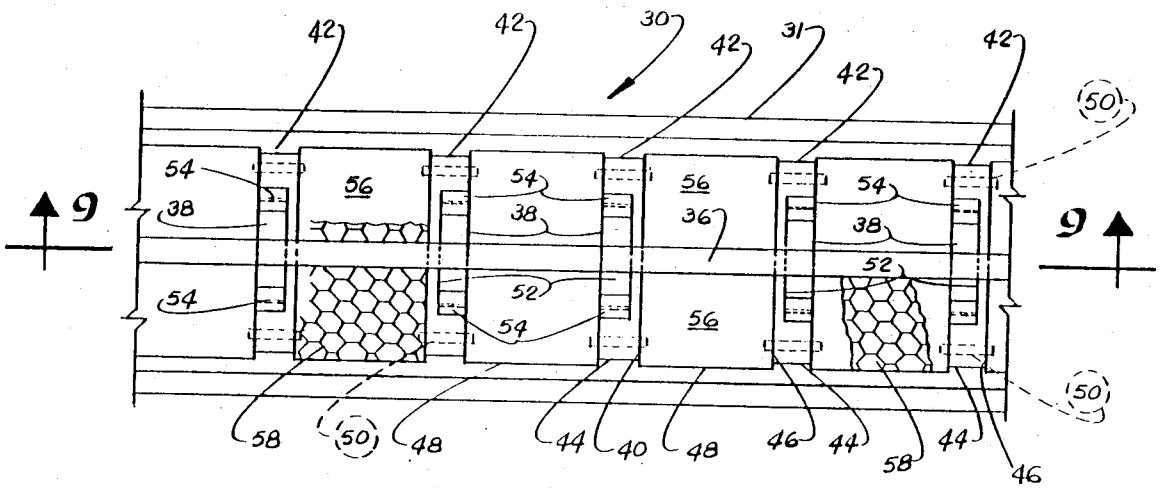
FIG. 7 is a plan view of still another modified form of skid rail.
Figure 8:
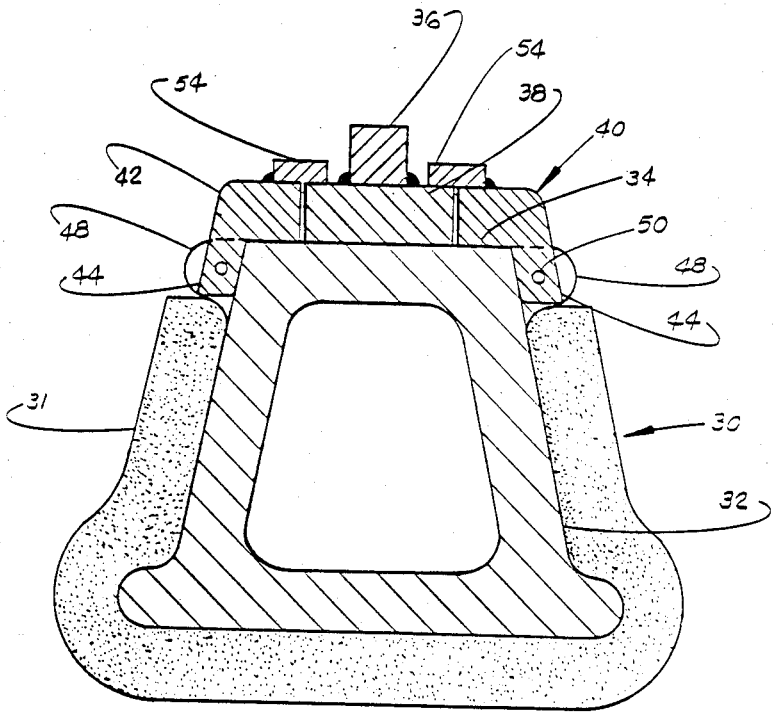
FIG. 8 is a transverse sectional view of the modified form of skid rail taken along line 8—8 in FIG. 7.
Figure 9:
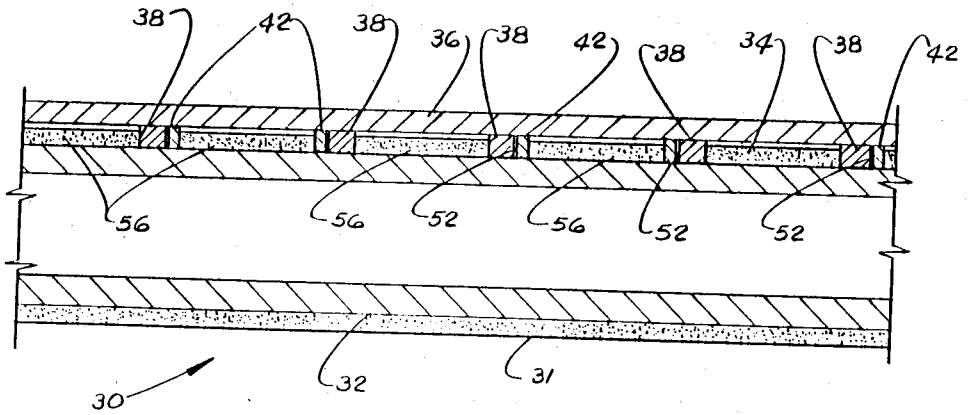
FIG. 9 is a vertical longitudinal sectional view of the modified skid rail taken along line 9—9 in FIG. 7.

Still another embodiment of the invention is shown in FIGS. 7, 8 and 9, wherein skid rail 30 includes truncated triangular pipe 32 with suitable insulation 31 on its lower surface and sides and having flat top surface 34 on which wear bar 36 is mounted. Blocks 38 support and secure wear bar 36 by welding. Blocks 38 are uniformly spaced along wear bar 36 with the spacing being provided so that wear bar 36 is not subject to damage due to the slabs or work pieces being moved thereon. Means 40 is provided to retain wear bar 36 and blocks 38 in the desired position relative to surface 34.

Such retaining means 40 includes bracket 42 which extends across top surface 34 of skid rail 30 and has its outer ends 44 depending into slots 46 in flanges 48 of skid rail 30 and secured therein by suitable securing means 50. Such securing means 50 may be spring loaded pins which extend into holes in flange 48. Bracket 42 includes recess 52 in its central portion into which block 38 is positioned. As can be seen from FIG. 4, brackets 42 are alternatively positioned so that recesses 52 of adjacent brackets 42 face in opposite directions to secure blocks 38 and wear bar 36 as best shown in FIG. 7. Caps 54 are secured to brackets 42 in position to cover the outer edge of blocks 38 as shown in FIGS. 7 and 8.

Suitable insulating material 56 is placed within and around reinforcing frame 58 which is secured to surface 34 of pipe 32 by welding. In FIG. 7 portions of insulating material 56 have been omitted to show reinforcing frame 58. Insulation material 56 is similar to insulation material 26 and extends under wear bar 36 between blocks 38. Also the material of the other components of this modified form are the same as those in the preferred form previously described.

What is claimed is:

1. A skid rail for a reheat furnace comprising a hollow structural member having an upper flat surface, a support block having a leg secured to said flat upper surface of said structural member and flanges extending outward at the upper end of said leg, a wear bar having an axial opening extending therethrough which is open at its lower portion and wider at its upper portion to receive said support block therein, and means for securing said wear bar on its support block to prevent axial movement of the wear bar with respect to said upper surface of said hollow structural member, said wear bar being of a material having low thermal conductivity at elevated temperatures.

2. A skid rail according to claim 1 wherein the material of said wear bar is an iron, chrome, cobalt alloy.

3. A skid rail according to claim 1 wherein the material of said wear bar and said blocks is a nickel based alloy.

4. A skid rail according to claim 1 wherein the material of said securing means is similar to the material of said structural member.

5. A skid rail according to claim 1 wherein said support block is T-shaped, and the axial opening is said wear bar is T-shaped and sized to receive said support block therein.

6. A skid rail according to claim 1 wherein said wear bar includes a plurality of aligned short sections, and a pad secured to the upper surface of said skid rail between said short sections.

7. A skid rail according to claim 6 wherein said wear bar includes a T-shaped opening along its lower surface, said blocks having a T-shape to engage in said T-shaped opening of said wear bar, said block being secured to said upper surface of said structural member.

8. A skid rail according to claim 1 wherein said wear bar includes intermittent parallel wear bars along said upper surface of said structural member.

9. A skid rail according to claim 1 wherein said blocks are uniformly spaced along said wear bar and are spaced sufficiently close to support said wear bar adequately while being subjected to work piece loading.

10. A skid rail according to claim 1 wherein said structural member is a truncated triangular pipe.

11. A skid rail according to claim 1 including insulation covering substantially all of said upper surface of said structural member around and between said blocks and under said wear bar.

12. A skid rail for a reheat furnace comprising a hollow structural member having an upper flat surface, a wear bar, a plurality of support blocks, and means coacting with said support blocks for securing said wear bar on the upper surface of said structural member, said wear bar being of a material having low thermal conductivity at elevated temperatures, said securing means includes a plurality of cleats secured to the upper surface of said structural member and positioned to engage said blocks to secure said wear bar to said upper surface with a space under said wear bar between blocks, said cleats each are U-shaped and include a base, a pair of legs, and a pair of caps secured to said legs in overlying relationship to the blocks positioned between the legs of said base to prevent the blocks from moving on said surface, and a stop positioned on the other side of said block.

13. A skid rail comprising a hollow structural member, a wear bar being of a material having low thermal conductivity and high strength at elevated temperatures, said wear bar being a different material than said structural member, and means for securing said wear bar in a position above and along the length of the upper surface of said structural member wherein said securing means includes a plurality of brackets extending across the upper surface of said structural member, said brackets having a recess into which said support blocks are received, and means for securing said brackets to said structural member.

* * * * *